US011952763B2

(12) United States Patent
Hannah

(10) Patent No.: US 11,952,763 B2
(45) Date of Patent: Apr. 9, 2024

(54) TOILET OVERFLOW PREVENTION ASSEMBLY

(71) Applicant: Michael Hannah, Southfield, MI (US)

(72) Inventor: Michael Hannah, Southfield, MI (US)

( * ) Notice: Subject to any disclaimer, the term of this patent is extended or adjusted under 35 U.S.C. 154(b) by 706 days.

(21) Appl. No.: 17/183,465

(22) Filed: Feb. 24, 2021

(65) Prior Publication Data

US 2022/0268006 A1 Aug. 25, 2022

(51) Int. Cl.
*E03D 11/02* (2006.01)
*E03D 11/13* (2006.01)

(52) U.S. Cl.
CPC ..... *E03D 11/02* (2013.01); *E03D 11/13* (2013.01)

(58) Field of Classification Search
CPC ..... E03D 11/02; E03D 11/13; Y10S 4/901
USPC ..... 4/420, 251.1, 427, 661, 901
See application file for complete search history.

(56) References Cited

U.S. PATENT DOCUMENTS 2,658,201 A * 11/1953 Sherwood ..... E03D 11/02 4/300
3,085,611 A * 4/1963 Dolnick ..... A47K 13/24 D23/311
3,262,132 A * 7/1966 Mann ..... E03D 11/00 4/427
3,408,661 A * 11/1968 Hammond ..... A47K 13/24 428/181
4,204,285 A * 5/1980 Pak ..... E03D 11/00 4/DIG. 15
5,067,185 A * 11/1991 Kohler ..... A47K 13/16 4/DIG. 18
5,560,049 A * 10/1996 Robinson ..... A47K 13/242 4/901
5,581,824 A * 12/1996 Crook, Sr. ..... A47K 13/242 4/901
6,085,361 A 7/2000 Whitaker
6,457,188 B1 10/2002 Lindberg
D506,342 S 6/2005 Amorin
8,691,024 B2 4/2014 Barniak, Jr.
8,776,280 B2 7/2014 Baranj
9,394,676 B2 * 7/2016 Morris ..... E03D 11/13
10,352,031 B2 * 7/2019 Muellenbach ..... E03D 11/14
10,550,560 B2 2/2020 Biermann
2006/0059610 A1 3/2006 Conant
2017/0058502 A1 * 3/2017 Welliver ..... E03D 11/13
2020/0048886 A1 * 2/2020 Ahola ..... E03D 11/02
2021/0369063 A1 * 12/2021 Drummer ..... E03D 9/00

FOREIGN PATENT DOCUMENTS

WO WO2015184540 12/2015

* cited by examiner

*Primary Examiner* — David P Angwin
*Assistant Examiner* — William R Klotz

(57) ABSTRACT

A toilet overflow prevention assembly for capturing overflowing water from a toilet includes a collar that is comprised of a flexible material. The collar can be positionable around a bowl of a toilet thereby facilitating the collar to capture water overflowing from the bowl. Additionally, the collar is comprised of a fluid impermeable material to inhibit the water from passing therethrough. A drain is integrated into the collar to drain the water outwardly therefrom. A closure is hingedly coupled to the collar and the closure is positionable in a locked position when the collar is positioned in the closed position for retaining the collar in the closed position.

10 Claims, 8 Drawing Sheets

TOILET OVERFLOW PREVENTION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to overflow prevention devices and more particularly pertains to a new overflow prevention device for capturing water overflowing from a toilet. The device includes a collar that is positionable around a toilet and a series of fluid channels integrated therein for draining water that overflows from the toilet into an appropriate drain.

(2) Description of Related Art Including Information Disclosed Under 37 CFR 1.97 and 1.98

The prior art relates to overflow prevention devices including a variety of surrounds that are positionable around a base of a toilet for capturing or diverting water that overflows from the toilet. The prior art discloses a housing that is attachable to a bowl of a toilet and which includes a depression integrated therein for draining water that overflows from the toilet. The prior art further discloses a surround that is positionable around a toilet for capturing water that overflows from the toilet.

BRIEF SUMMARY OF THE INVENTION

An embodiment of the disclosure meets the needs presented above by generally comprising a collar that is comprised of a flexible material. The collar can be positionable around a bowl of a toilet thereby facilitating the collar to capture water overflowing from the bowl. Additionally, the collar is comprised of a fluid impermeable material to inhibit the water from passing therethrough. A drain is integrated into the collar to drain the water outwardly therefrom. A closure is hingedly coupled to the collar and the closure is positionable in a locked position when the collar is positioned in the closed position for retaining the collar in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
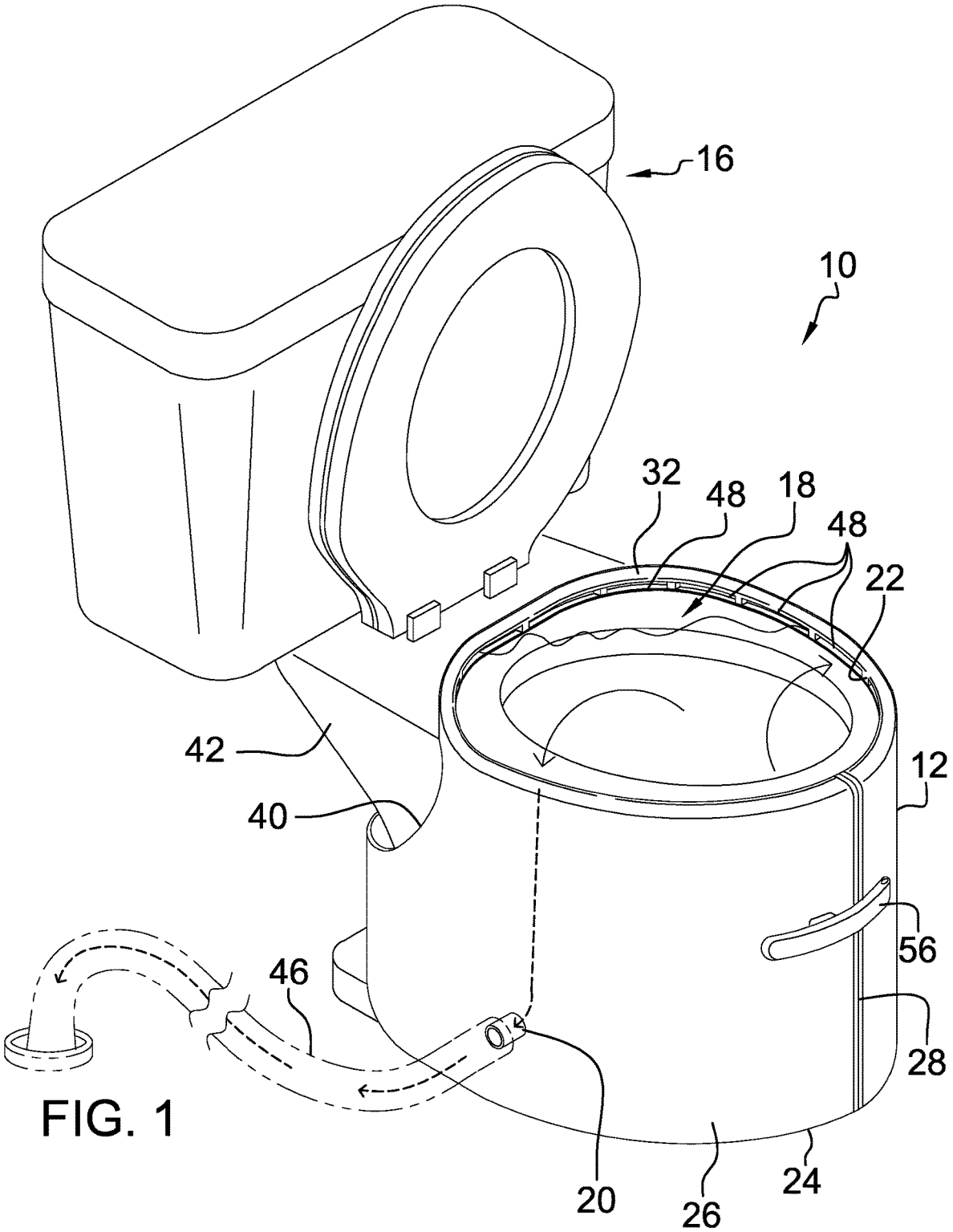
FIG. 1 is a perspective in-use view of a toilet overflow prevention assembly according to an embodiment of the disclosure.
Figure 2:
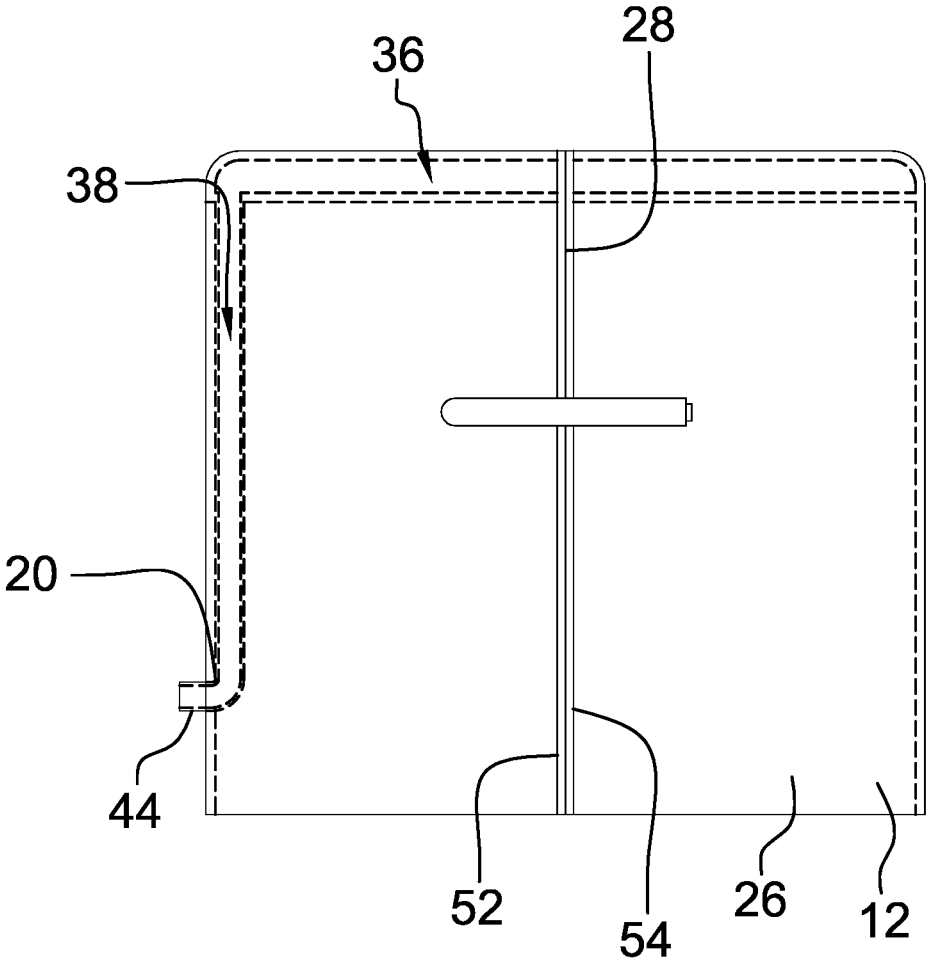
FIG. 2 is a front phantom view of an embodiment of the disclosure.
Figure 3:
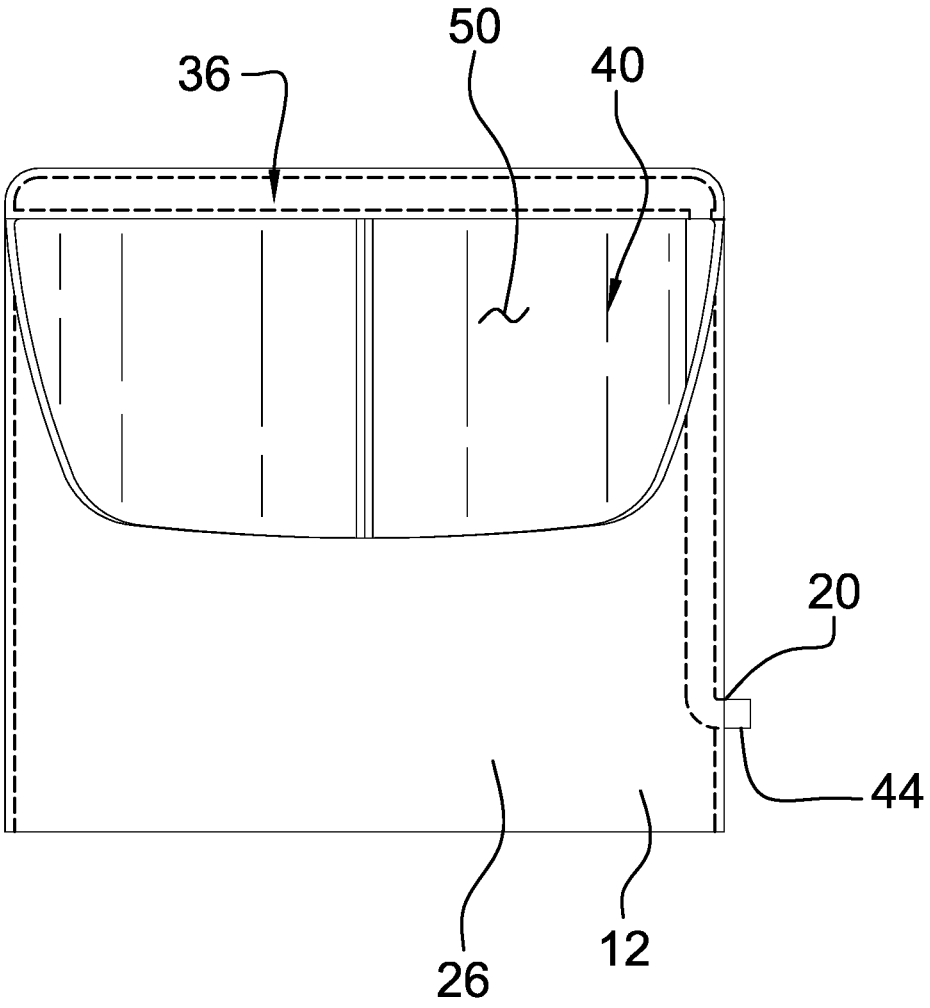
FIG. 3 is a back phantom view of an embodiment of the disclosure.
Figure 4:
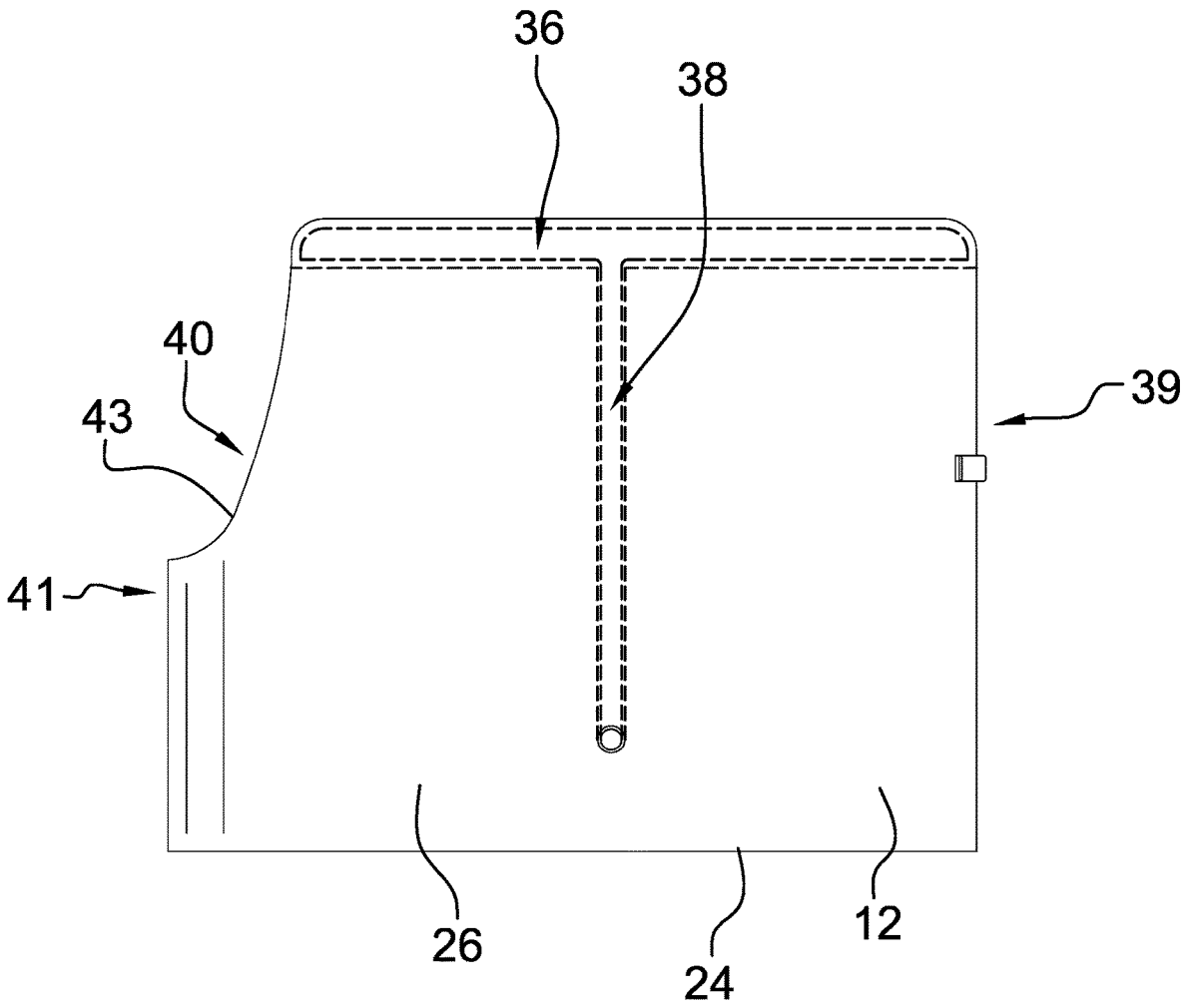
FIG. 4 is a right side phantom view of an embodiment of the disclosure.
Figure 5:
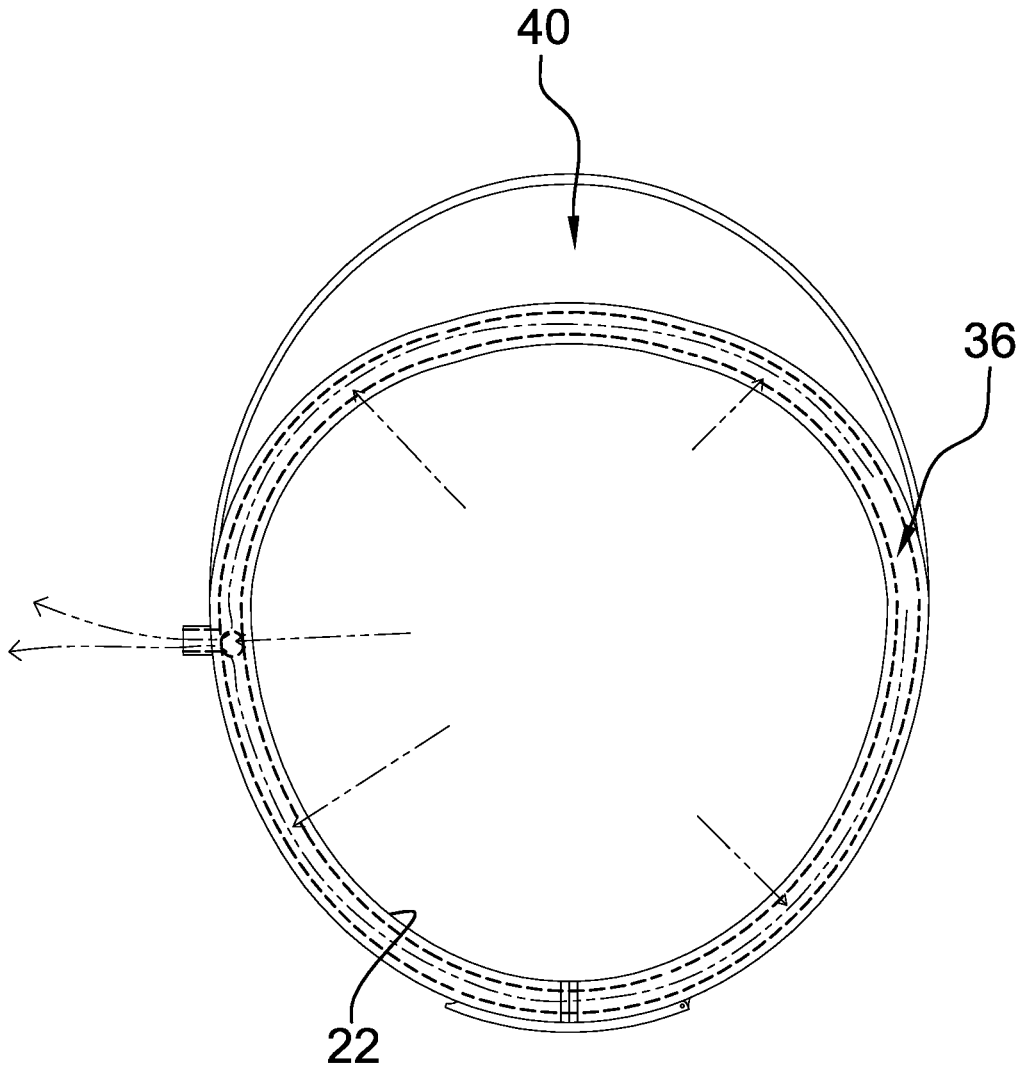
FIG. 5 is a top view of an embodiment of the disclosure.
Figure 6:
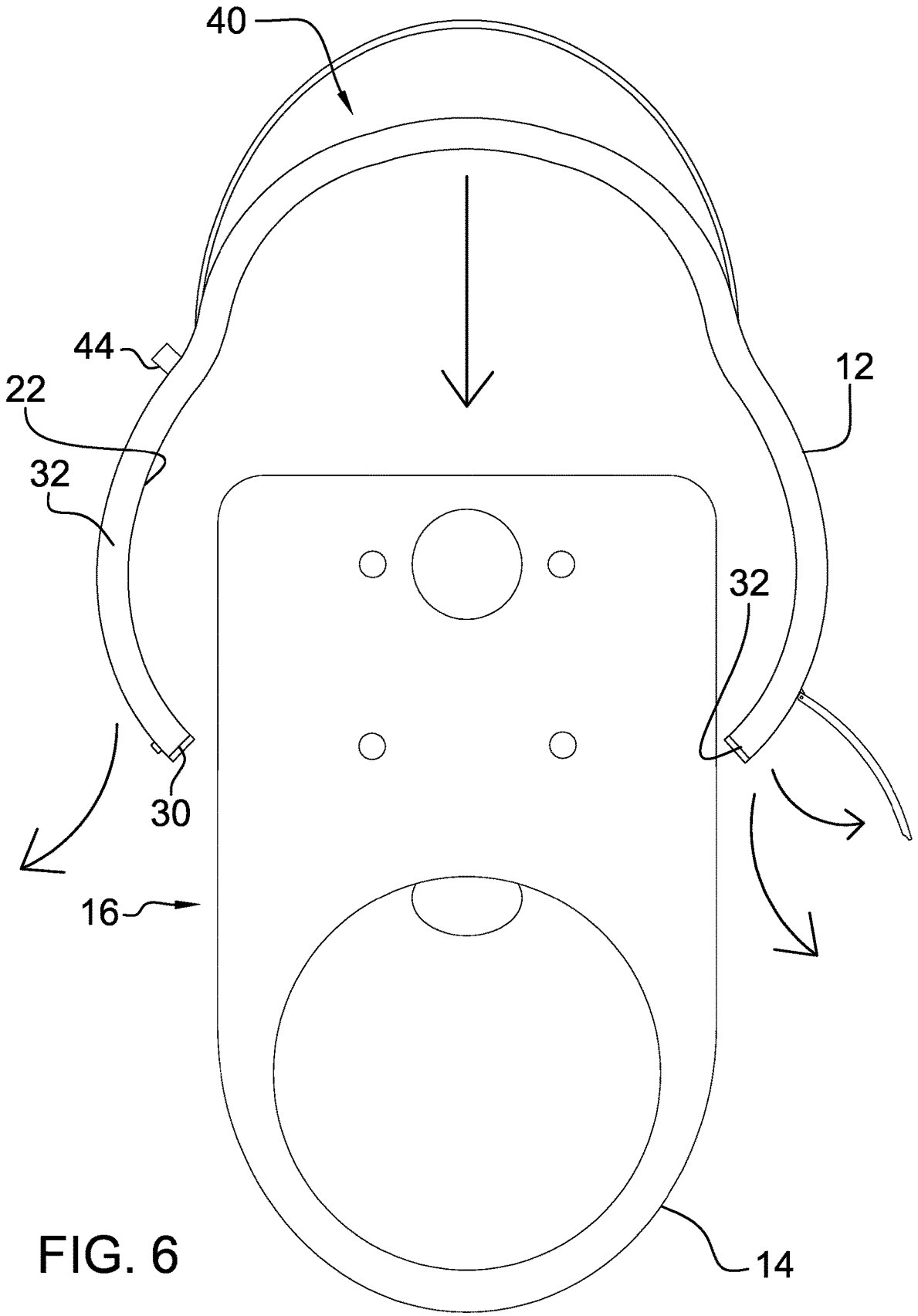
FIG. 6 is a bottom view of an embodiment of the disclosure showing a collar being positioned around a toilet.
Figure 7:
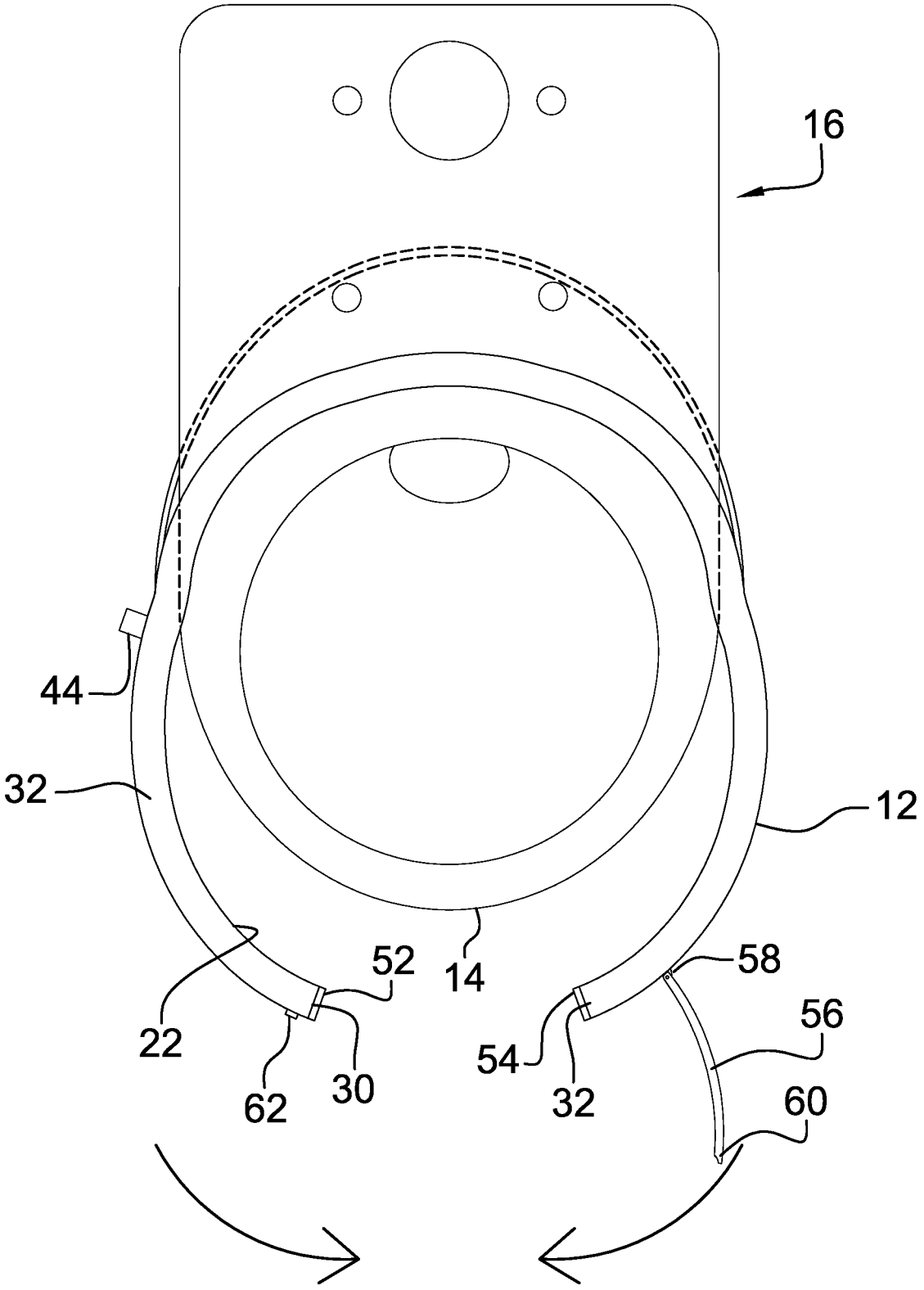
FIG. 7 is a top view of an embodiment of the disclosure showing a collar being positioned around a toilet.
Figure 8:
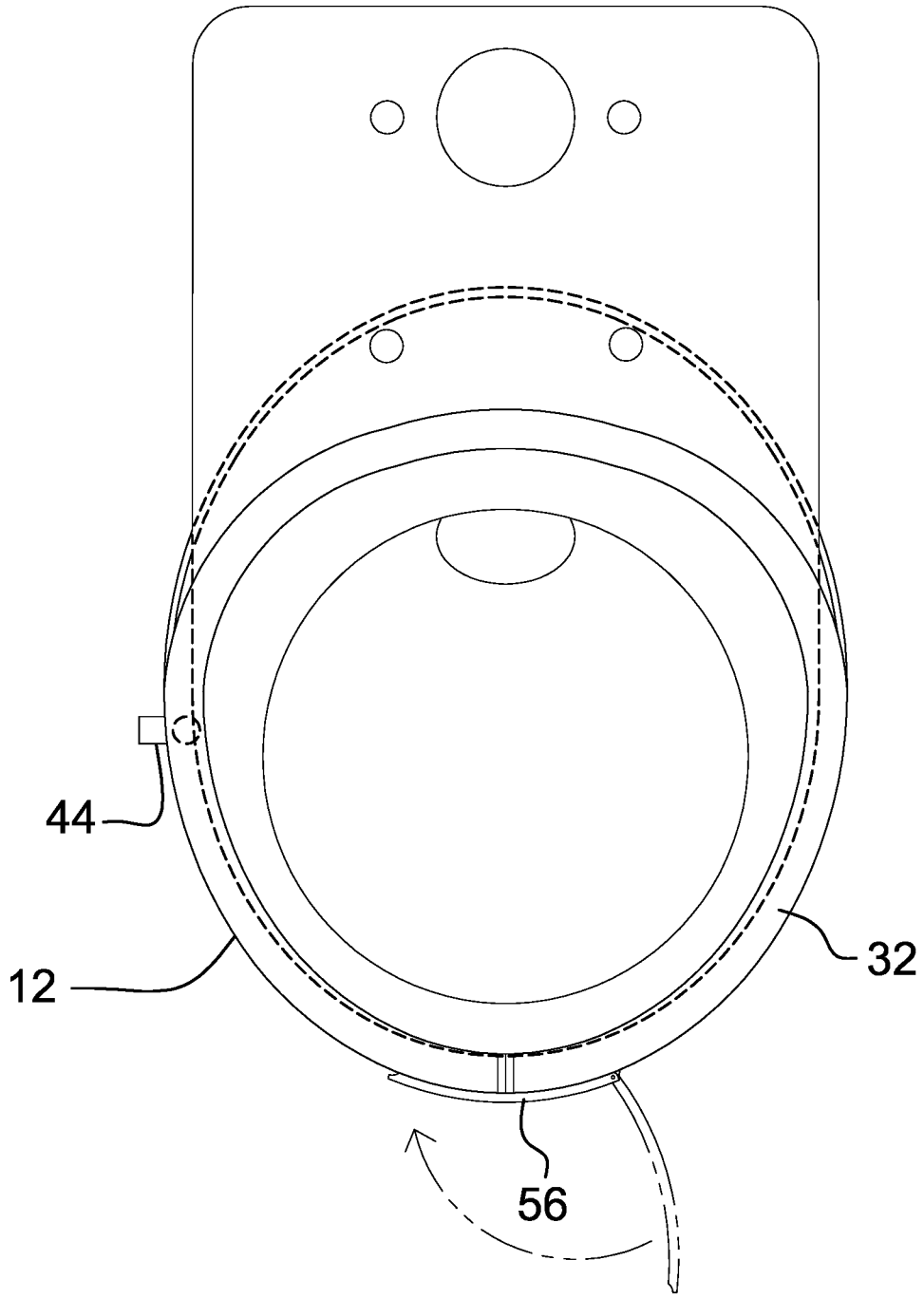
FIG. 8 is a top view of an embodiment of the disclosure showing a collar being closed around a toilet.

With reference now to the drawings, and in particular to FIGS. 1 through 8 thereof, a new overflow prevention device embodying the principles and concepts of an embodiment of the disclosure and generally designated by the reference numeral 10 will be described.

As best illustrated in FIGS. 1 through 8, the toilet overflow prevention assembly 10 generally comprises a collar 12 that is comprised of a flexible material such that the collar 12 can be positionable around a bowl 14 of a toilet 16. In this way the collar 12 can capture water 18 overflowing from the bowl 14. The collar 12 is comprised of a fluid impermeable material to inhibit the water 18 from passing therethrough. Additionally, the collar 12 has a drain 20 integrated therein to drain the water 18 outwardly therefrom. The toilet 16 may be a plumbing fixture in a house or other type of occupancy.

The collar 12 has a top edge 22, a bottom edge 24 and an outer wall 26 extending therebetween. The drain 20 extends through the outer wall 26 and the drain 20 is positioned adjacent to the bottom edge 24. The outer wall 26 has a cut 28 extending therethrough and the cut 28 extends between the top edge 22 and the bottom edge 24. In this way the collar 12 can be positioned in an open position having the cut 28 being spread open to accommodate the bowl 14 of the toilet 16. The collar 12 is positionable in a closed position having the cut 28 being closed to surround the bowl 14 of the toilet 16. The cut 28 has a first bounding edge 30 and a second bounding edge 32. The outer wall 26 curls inwardly adjacent to the top edge 22 to define a lip 34 that extends over an upper threshold 36 of the bowl 14 of the toilet 16.

The outer wall 26 has a fluid channel 36 integrated therein and the fluid channel 36 is aligned with the top edge 22 of the collar 12. In this way the fluid channel 36 captures the water 18 overflowing from the bowl 14 of the toilet 16. The fluid channel 36 extends around an entire perimeter of the collar 12. The outer wall 26 has a drain channel 38 integrated therein and the drain channel 38 extends between the fluid channel 36 and the drain 20 in the outer wall 26. In this way the drain channel 38 directs the water 18 overflowing from the toilet 16 into the drain 20.

The outer wall 26 has an opening 40 extending therethrough and the opening 40 extends from a point adjacent to the top edge 22 of the collar 12 toward the bottom edge 24 of the collar 12. In this way the opening 40 can accommodate a rear portion 42 of the toilet 16 when the collar 12 is wrapped around the bowl 14 of the toilet 16. Additionally, the opening 40 is positioned on an opposite side of the collar 12 with respect to the cut 28. The top edge 22 of the collar 12 has a diameter that is greater than the diameter of the bottom edge 24 of the collar 12. The top edge 22 of the collar 12 is aligned with the bottom edge 24 of the collar 12 on a front side 39 of the collar 12. As is most clearly shown in FIG. 4, the top edge 22 of the collar 12 is offset with the bottom edge 24 of the collar 12 on a back side 41 of the collar. Additionally, a bounding edge 43 of the opening 40 in the outer wall 26 of the collar 12 slopes rearwardly from the top edge 22.

A nipple 44 is coupled to and extends away from the outer wall 26 of the collar 12 such that the nipple 44 can be fluidly coupled to a drain hose 46. The nipple 44 is aligned with the drain 20 in the outer wall 26 of the collar 12 to direct the overflowing water 18 into the drain hose 46. The drain hose 46 might be routed into a drain of an adjacent sink or other drain that is plumbed into a sewer system of the house in which the toilet 16 is positioned.

A plurality of gaskets 48 is provided and each of the gaskets 48 is coupled to an inside surface 50 of the outer wall 26 of the collar 12. Each of the gaskets 48 is aligned with the top edge 22 of the collar 12 and the gaskets 48 is spaced apart from each other and is distributed around the top edge 22. In this way the gaskets 48 can engage the upper threshold 36 of the toilet 16 thereby inhibiting the overflowing water 18 from spilling over the top edge 22 of the collar 12.

A first seal 52 is coupled to the first bounding edge 30 of the cut 28 in the outer wall 26 of the collar 12 and the first seal 52 extends along a full length of the first bounding edge 30. A second seal 54 is coupled to the second bounding edge 32 of the cut 28 in the outer wall 26 of the collar 12 and the second seal 54 extends along a full length of the second bounding edge 32. The second seal 54 abuts the first seal 52 when the collar 12 is positioned in the closed position. Additionally, the first seal 52 forms a fluid impermeable seal with the second seal 54 to inhibit the overflowing water 18 from passing through the cut 28.

A closure 56 is provided and the closure 56 is hingedly coupled to the collar 12. The closure 56 is positionable in a locked position when the collar 12 is positioned in the closed position for retaining the collar 12 in the closed position. The closure 56 is positionable in an unlocked position thereby facilitating the collar 12 to be positioned in the open position. The closure 56 has a first end 58 and a second end 60, and the first end 58 is hingedly coupled to an outer surface 62 of the outer wall 26 of the collar 12. The closure 56 extends across the cut 28 and the second end 60 engages an engagement point 64 on the outer wall 26 of the collar 12 when the closure 56 is positioned in the locked position for compressing the first seal 52 against the second seal 54.

In use, the collar 12 is positioned in the open positioned and the collar 12 is positioned around the bowl 14 of the toilet 16. The collar 12 is closed around the toilet 16 and the closure 56 is positioned in the locked position. Additionally, the drain hose 46 is coupled to the nipple 44. In this way water 18 that is overflowing from the bowl 14 of the toilet 16 will flow into the fluid channel 36, downwardly in the drain channel 38 and outwardly through said drain 20. Thus, the overflowing water 18 is directed into the drain hose 46 rather than flowing onto the floor of the room in which the toilet 16 is positioned. The collar 12 is removed from the bowl 14 of the toilet 16 when the toilet 16 is no longer overflowing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet overflow prevention assembly for directing overflowing water from a toilet into a drain, said assembly comprising:

a collar being comprised of a flexible material wherein said collar is configured to be positionable around a bowl of a toilet thereby facilitating said collar to capture water overflowing from the bowl, said collar being comprised of a fluid impermeable material wherein said collar is configured to inhibit the water from passing therethrough, said collar having a drain being integrated therein wherein said drain is configured to drain the water outwardly therefrom;

a nipple being coupled to and extending away from said collar wherein said nipple is configured to be fluidly coupled to a drain hose, said nipple being aligned with said drain in said outer wall of said collar wherein said nipple is configured to direct the overflowing water into the drain hose;

a closure being hingedly coupled to said collar, said closure being positionable in a locked position when said collar is positioned in a closed position for retaining said collar in said closed position, said closure being positionable in an unlocked position thereby facilitating said collar to be positioned in an open position;

wherein said collar has a top edge, a bottom edge and an outer wall extending therebetween, said drain extending through said outer wall, said drain being positioned adjacent to said bottom edge; and wherein said outer wall curls inwardly adjacent to said top edge to define a lip wherein said lip is configured to extend over an upper threshold of the bowl of the toilet.

2. The assembly according to claim 1, wherein said outer wall has a cut extending therethrough, said cut extending between said top edge and said bottom edge thereby facilitating said collar to be positioned in said open position having said cut being spread open wherein said cut is configured to accommodate the bowl of the toilet, said collar being positionable in said closed position having said cut being closed wherein said collar is configured to surround the bowl of the toilet, said cut having a first bounding edge and a second bounding edge.

3. The assembly according to claim 1, wherein said outer wall has a fluid channel being integrated therein, said fluid channel being aligned with said top edge of said collar wherein said fluid channel is configured to capture the water overflowing from the toilet bowl, said fluid channel extending around an entire perimeter of said collar.

4. The assembly according to claim 3, wherein said outer wall has a drain channel being integrated therein, said drain channel extending between said fluid channel and said drain in said outer wall wherein said drain channel is configured to direct the water overflowing from the toilet into said drain.

5. The assembly according to claim 2, wherein said outer wall has an opening extending therethrough, said opening extending from a point adjacent to said top edge of said collar toward said bottom edge of said collar wherein said opening is configured to accommodate a rear portion of the toilet when said collar is wrapped around the bowl of the toilet, said opening being positioned on an opposite side of said collar with respect to said cut.

6. The assembly according to claim 1, further comprising a plurality of gaskets, each of said gaskets being coupled to an inside surface of said outer wall of said collar, each of said gaskets being aligned with said top edge of said collar, said gaskets being spaced apart from each other and being distributed around said top edge wherein said gaskets are configured to engage the upper threshold of the toilet thereby inhibiting the overflowing water from spilling over said top edge of said collar.

7. The assembly according to claim 2, further comprising a first seal being coupled to said first bounding edge of said cut in said outer wall of said collar, said first seal extending along a full length of said first bounding edge.

8. The assembly according to claim 7, further comprising a second seal being coupled to said second bounding edge of said cut in said outer wall of said collar, said second seal extending along a full length of said second bounding edge, said second seal abutting said first seal when said collar is positioned in said closed position, said first seal forming a fluid impermeable seal with said second seal wherein said first seal and said second seal are configured to inhibit the overflowing water from passing through said cut.

9. The assembly according to claim 2, wherein said closure has a first end and a second end, said first end being hingedly coupled to an outer surface of said outer wall of said collar, said closure extending across said cut, said second end engaging an engagement point on said outer wall of said collar when said closure is positioned in said locked position for compressing said first seal against said second seal.

10. A toilet overflow prevention assembly for directing overflowing water from a toilet into a drain, said assembly comprising:

a collar being comprised of a flexible material wherein said collar is configured to be positionable around a bowl of a toilet thereby facilitating said collar to capture water overflowing from the bowl, said collar being comprised of a fluid impermeable material wherein said collar is configured to inhibit the water from passing therethrough, said collar having a drain being integrated therein wherein said drain is configured to drain the water outwardly therefrom, said collar having a top edge, a bottom edge and an outer wall extending therebetween, said drain extending through said outer wall, said drain being positioned adjacent to said bottom edge, said outer wall having a cut extending therethrough, said cut extending between said top edge and said bottom edge thereby facilitating said collar to be positioned in an open position having said cut being spread open wherein said cut is configured to accommodate the bowl of the toilet, said collar being positionable in a closed position having said cut being closed wherein said collar is configured to surround the bowl of the toilet, said cut having a first bounding edge and a second bounding edge, said outer wall curling inwardly adjacent to said top edge to define a lip wherein said lip is configured to extend over an upper threshold of the bowl of the toilet, said outer wall having a fluid channel being integrated therein, said fluid channel being aligned with said top edge of said collar wherein said fluid channel is configured to capture the water overflowing from the toilet bowl, said fluid channel extending around an entire perimeter of said collar, said outer wall having a drain channel being integrated therein, said drain channel extending between said fluid channel and said drain in said outer wall wherein said drain channel is configured to direct the water overflowing from the toilet into said drain, said outer wall having an opening extending therethrough, said opening extending from a point adjacent to said top edge of said collar toward said bottom edge of said collar wherein said opening is configured to accommodate a rear portion of the toilet when said collar is wrapped around the bowl of the toilet, said opening being positioned on an opposite side of said collar with respect to said cut;

a nipple being coupled to and extending away from said outer wall of said collar wherein said nipple is configured to be fluidly coupled to a drain hose, said nipple being aligned with said drain in said outer wall of said collar wherein said nipple is configured to direct the overflowing water into the drain hose;

a plurality of gaskets, each of said gaskets being coupled to an inside surface of said outer wall of said collar, each of said gaskets being aligned with said top edge of said collar, said gaskets being spaced apart from each other and being distributed around said top edge wherein said gaskets are configured to engage the upper threshold of the toilet thereby inhibiting the overflowing water from spilling over said top edge of said collar;

a first seal being coupled to said first bounding edge of said cut in said outer wall of said collar, said first seal extending along a full length of said first bounding edge;

a second seal being coupled to said second bounding edge of said cut in said outer wall of said collar, said second seal extending along a full length of said second bounding edge, said second seal abutting said first seal when said collar is positioned in said closed position, said first seal forming a fluid impermeable seal with said second seal wherein said first seal and said second seal are configured to inhibit the overflowing water from passing through said cut; and a closure being hingedly coupled to said collar, said closure being positionable in a locked position when said collar is positioned in said closed position for retaining said collar in said closed position, said closure being positionable in an unlocked position thereby facilitating said collar to be positioned in said open position, said closure having a first end and a second end, said first end being hingedly coupled to an outer surface of said outer wall of said collar, said closure extending across said cut, said second end engaging an engagement point on said outer wall of said collar when said closure is positioned in said locked position for compressing said first seal against said second seal.

* * * * *